US005408764A

United States Patent [19]

Wut

[11] Patent Number: 5,408,764

[45] Date of Patent: Apr. 25, 1995

[54] MOTION ACTIVATED ILLUMINATING FOOTWEAR AND LIGHT MODULE THEREFOR

[75] Inventor: Siu B. Wut, Hong Kong, Hong Kong

[73] Assignee: East Asia Services Ltd., Hong Kong, Hong Kong

[21] Appl. No.: 189,969

[22] Filed: Feb. 1, 1994

[51] Int. Cl.[6] ..... A43B 23/00

[52] U.S. Cl. ..... 36/137; 36/136; 362/103

[58] Field of Search ..... 36/137, 139, 136; 362/103, 802

[56] References Cited

U.S. PATENT DOCUMENTS

| | | | |
|---|---|---|---|
| 2,572,760 | 10/1951 | Rikelman | 36/137 |
| 2,671,209 | 3/1954 | Habib | 362/802 |
| 2,816,284 | 12/1957 | Campanell | 362/103 |
| 2,976,622 | 3/1961 | Shearouse | 36/137 |
| 3,800,133 | 3/1974 | Duval | 36/137 |
| 3,893,247 | 7/1975 | Dana, III . | |
| 3,946,505 | 3/1976 | Dana, III . | |
| 4,014,115 | 3/1977 | Reichert | 36/137 |
| 4,158,922 | 6/1979 | Dana, III | 36/137 |
| 4,253,253 | 3/1981 | McCormick | 36/137 |
| 4,848,009 | 7/1989 | Rodgers | 36/137 |
| 5,188,447 | 2/1993 | Chiang et al. | 36/137 |
| 5,285,586 | 2/1994 | Goldston | 36/137 |
| 5,303,131 | 4/1994 | Wu | 36/137 |

FOREIGN PATENT DOCUMENTS

| | | | |
|---|---|---|---|
| 0121026 | 10/1984 | European Pat. Off. . | |
| 335467 | 10/1989 | European Pat. Off. | 36/137 |
| 2675025 | 10/1992 | France | 36/137 |
| 2608485 | 9/1977 | Germany . | |
| 2838770 | 3/1980 | Germany | 36/137 |
| 011681 | 6/1993 | WIPO | 36/137 |

*Primary Examiner*—David T. Fidei
*Assistant Examiner*—Marle Denise Patterson
*Attorney, Agent, or Firm*—Richard M. Goldberg

[57] ABSTRACT

Motion activated illuminating footwear includes a heel having a transparent portion; and a light module positioned within the heel, the light module including two light emitting diodes (LEDs) for providing illumination, the LEDs being located so as to be visible exteriorly of the heel through the transparent portion thereof and the LEDs having positive and negative terminals, a printed circuit board supporting the LEDs, a battery for supplying power to the LEDs, leads connecting the positive terminals of the LEDs to the battery, a switch which alternately provides contact between the battery and the negative terminal of the LEDs upon movement of the footwear, the switch including a coil extension spring electrically connected with the negative terminals of the LEDs, for intermittently contacting the battery as a result of movement of the footwear, the spring having a first end supported by the printed circuit board and being electrically connected by the printed circuit board to the negative terminals of the LEDs, and an opposite second free end extending above and out of contact with the battery when the footwear is not moving and intermittently contacting the battery as a result of movement of the footwear, such that the battery is disconnected from the negative terminal of the LEDs upon upward motion of the spring and the battery is connected to the negative terminal of the LEDs upon downward motion of the spring so as to cause illumination of the LEDs.

20 Claims, 3 Drawing Sheets

MOTION ACTIVATED ILLUMINATING FOOTWEAR AND LIGHT MODULE THEREFOR

BACKGROUND OF THE INVENTION

This invention relates to footwear, and more particularly, is directed to motion activated illuminating footwear having a light module therein.

It is well known to position a light inside of a heel of footwear, with the light being activated all of the time. In such known construction, the light can be turned off by means of a switch extending from the heel of the footwear. See, for example, U.S. Pat. No. 4,253,253 to McCormick. However, this construction provides certain disadvantages. First, there is the possibility that the switch is not turned off, in which case the light will burn out in a very short period of time. Second, a connection must be made between the switch on the outside of the heel to the circuitry within the heel, which adds to the cost and complexity of the footwear. Third, there is the possibility that the switch can be damaged, for example, by banging the shoe against an object, since the switch is externally accessible.

For the above reasons, it is preferred to position the entire circuitry and switch therefor entirely within the heel of the footwear. In this regard, it is well known to position a light, such as a light emitting diode (LED) inside of the heel of footwear, such that the light is visible from the exterior of the footwear, with the light being activated by means of a pressure sensitive switch. In particular, when the wearer steps down and exerts pressure on the pressure sensitive switch when walking or running, a circuit is closed so as to supply power to activate the LED. When the wearer steps up, relieving pressure from the pressure sensitive switch, the circuit is opened so as disconnect power to the LED. Examples of such footwear are disclosed in U.S. Pat. Nos. 5,188,447 to Chiang et al, European Patent Application No. 0 121 026, and U.S. Pat. No. 3,800,133 to Duval. However, the use of a pressure sensitive switch and the associated circuit connections increases the cost and complexity of the footwear.

It is also known to position a light inside of the heel of footwear, with the light being activated by a mercury tilt switch in the footwear. See, for example, German Offenlegungsschrift No. 2,608,485, the aforementioned European Patent Application No. 0 121 026, U.S. Pat. No. 4,158,922 to Dana, III, U.S. Pat. No. 4,848,009 to Rodgers and U.S. Pat. No. 3,893,247 to Dana, III. However, the addition of the mercury tilt switch and the associated circuitry greatly adds to the cost and complexity of the footwear.

OBJECTS AND SUMMARY OF THE INVENTION

Accordingly, it is an object of the present invention to provide motion activated illuminating footwear that overcomes the problems with the aforementioned prior art.

It is another object of the present invention to provide motion activated illuminating footwear that does not require any costly and complex circuitry.

It is still another object of the present invention to provide motion activated illuminating footwear having a simple mechanical switch that is vibration sensitive.

It is yet another object of the present invention to provide motion activated illuminating footwear having a coil spring that operates as the mechanical switch.

It is a further object of the present invention to provide motion activated illuminating footwear in which the spring intermittently contacts the battery as a result of vibration caused by movement of the footwear, so as to intermittently turn the light on and off.

In accordance with an aspect of the present invention, a light module for footwear includes light source means for providing illumination, the light source means being located on the footwear so as to be visible exteriorly thereof and the light source means having first and second terminals of opposite polarity; power supply means for supplying power to the light source means; lead means for connecting the first terminal of the light source means to the power supply means; and switch means for alternately providing contact between the power supply means and the second terminal of the light source means upon movement of the footwear, the switch means including spring means, electrically connected with the second terminal of the light source means, for intermittently contacting the power supply means as a result of movement of the footwear; wherein the light source means is illuminated upon contact of the spring means with the power supply means.

The light source means includes at least one light emitting diode, and preferably, includes two light emitting diodes.

In addition, there is printed circuit board means for supporting the light source means, and the spring means includes a first end supported by the printed circuit board means and an opposite second free end extending above and out of contact with the power supply means when the footwear is not moving and intermittently contacting the power supply means as a result of movement of the footwear, such that the power supply means is disconnected from the second terminal of the light source means upon upward motion of the spring means and the power supply means is connected to the second terminal of the light source means upon downward motion of the spring means. It is preferred that the spring means include a coil extension spring.

Preferably, weight means is supported by the second free end of the spring means to enhance the contact of the second free end with the power supply means during the intermittent contact.

In addition, casing means holds the light source means, power supply means, lead means and spring means. Transparent lens casing means protects the light source means and enhances the degree of illumination of the light source means. The power supply means includes a battery.

In accordance with another aspect of the present invention, footwear includes a heel having a transparent portion; and a light module positioned within the heel, the light module including light source means for providing illumination, the light source means being located so as to be visible exteriorly of the heel through the transparent portion thereof and the light source means having first and second terminals of opposite polarity, power supply means for supplying power to the light source means, lead means for connecting the first terminal of the light source means to the power supply means, and switch means for alternately providing contact between the power supply means and the second terminal of the light source means upon movement of the footwear, the switch means including spring means, electrically connected with the second terminal of the light source means, for intermittently contacting the power supply means as a result of movement of the footwear; wherein the light source means is illuminated upon contact of the spring means with the power supply means.

In accordance with still another aspect of the present invention, motion activated illuminating footwear includes a heel having a transparent portion; and a light module positioned within the heel, the light module including light source means for providing illumination, the light source means being located so as to be visible exteriorly of the heel through the transparent portion thereof and the light source means having first and second terminals of opposite polarity, printed circuit board means for supporting the light source means, battery means for supplying power to the light source means, lead means for connecting the first terminal of the light source means to the battery means, and switch means for alternately providing contact between the battery means and the second terminal of the light source means upon movement of the footwear, the switch means including spring means, electrically connected with the second terminal of the light source means, for intermittently contacting the battery means as a result of movement of the footwear, the spring means having a first end supported by the printed circuit board means, the first end of the spring means being electrically connected by the printed circuit board means to the second terminal of the light source means, and an opposite second free end extending above and out of contact with the battery means when the footwear is not moving and intermittently contacting the battery means as a result of movement of the footwear, such that the battery means is disconnected from the second terminal of the light source means upon upward motion of the spring means and the battery means is connected to the second terminal of the light source means upon downward motion of the spring means so as to cause illumination of the light source means.

DETAILED DESCRIPTION OF THE PREFERRED EMBODIMENTS

Figure 1:
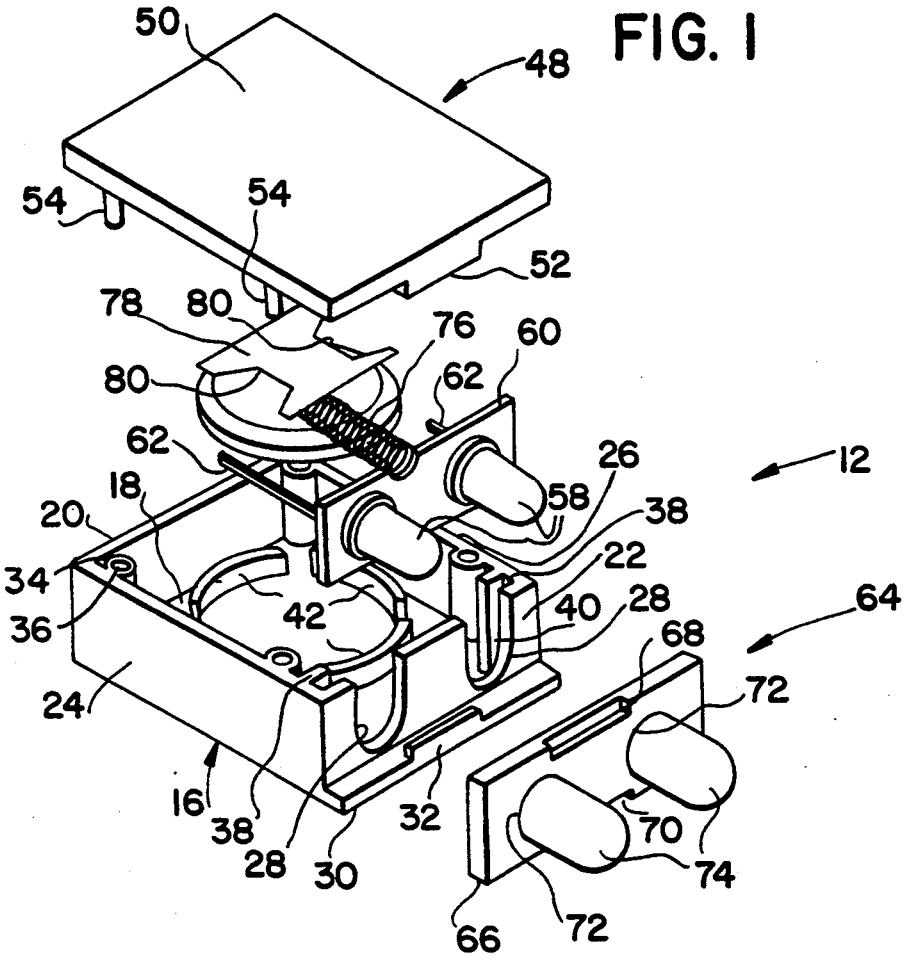
FIG. 1 is an exploded perspective view of a light module of the motion activated illuminating footwear according to the present invention.

Referring to the drawings in detail, motion activated illuminating footwear 10 according to the present invention includes a light module 12 incorporated into the heel 14 of footwear 10, such as a running shoe or the like.

Light module 12 includes a plastic case 16 including a rectangular bottom wall 18, a front side wall 20, a rear side wall 22 and left and right side walls 24 and 26. For example, case 16 can be made of an acrylic material. Side walls, 20, 22, 24 and 26 form a rectangular enclosure having the same dimensions as bottom wall 18 and secured thereto. As shown best in FIG. 1, rear side wall 22 includes two U-shaped openings 28 thereon, extending downwardly from the upper edge of rear side wall 22.

A lower rear lip 30 is formed along the rear edge of bottom wall 18, so as to extend rearwardly of rear side wall 22, with a tab 32 extending upwardly from the rear edge of lower rear lip 30, at the center thereof.

Two posts 34 extend upwardly along the inner surface of side wall 24 at opposite ends thereof, and two posts 34 extend upwardly along the inner surface of side wall 26 at opposite ends thereof. Each post 34 is secured to its respective side wall 24 or 26 and to bottom wall 18, and extends the entire height of its respective side wall 24 or 26. Further, each post 34 is provided with a central bore 36 therein.

Plastic case 16 further includes two flanges 38 extending inwardly toward each other from the rear ends of side walls 24 and 26. Each flange 38 extends inwardly only by a small amount, but extends the entire height of side walls 24 and 26 and is connected with bottom wall 18. Thus, a guide slot 40 is formed between flanges 38 and rear wall 22.

In addition, four relatively short arcuate guide walls 42 are formed equiangularly spaced along a common circle and connected with the upper surface of bottom wall 18, such that gaps 44 are formed between adjacent guide walls 42. Guide walls 42 correctly position a cylindrical battery 46 therein, such as a 3 volt lithium battery.

A plastic top cover 48, made for example from an acrylic material, is provided to close the upper open end of plastic case 16, and includes an upper wall 50 having outer dimensions which are identical to the outer dimensions defined by the combination of bottom wall 18 and lower rear lip 30 that extends therefrom, such that cover 48 rests on top of side walls 20, 22, 24 and 26 and also extends rearwardly of rear wall 22 by the same amount as lower rear lip 30. A tab 52 extends downwardly from the rear edge of upper wall 30, at the center thereof, in opposing relation to tab 32. In addition, the underside of upper wall 50 preferably includes a shallow recess 53 therein.

Further, four pins 54 extend downwardly from the lower surface of upper wall 50 and are positioned so as to locate within central bores 36 of posts 34. Accordingly, cover 48 is correctly aligned on case 16. In addition, pins 54 are fit within bores 36 with a press fit so that cover 48 is securely held on case 16.

Two ribs 56 extend downwardly from the lower surface of upper wall 50. When cover 48 is fit on case 16, the lower edges of ribs 56 abut against the upper surface of battery 46 at diametrically opposite sides thereof. As a result of ribs 56 pressing down on battery 46 and guide walls 42 restraining battery 46, battery 46 is securely held in place and cannot move about within case 16.

Two light emitting diodes (LEDs) 58 are mounted in spaced relation to a rear surface of a printed circuit board 60 having a generally rectangular configuration. Printed circuit board 60 fits within guide slot 40 and LEDs 58 extend outwardly through U-shaped openings 28. A positive LED lead 62 extends at one end through printed circuit board 60 to the positive terminal of each LED 58, and extends forwardly from printed circuit board 60 in a bent manner so as to be positioned below and in contact with the underside of battery 46, which constitutes the positive side of battery 46.

It is preferred to use light emitting diodes for the light source since LEDs provide a relatively high intensity with a relatively low energy consumption when compared with other conventional incandescent illumination devices. The low energy consumption enables the use of a smaller size and less costly battery compared to other light sources. This size reduction is of utmost importance in footwear. Further, LEDs are also available in assorted color lightings.

A plastic lens case 64 is provided at the rear of case 16 to protect LEDs 58 and to enhance the degree of illumination of LEDs 58. Specifically, lens case 64 includes a rectangular support wall 66 having upper and lower notches 68 and 70 therein for receiving tabs 32 and 52, respectively, which securely hold lens case 64 between lower rear lip 30 and top cover 48, at the rear ends thereof. Two spaced through openings 72 are provided in support wall 66, and two transparent, bullet-shaped plastic lens casings 74 are secured to support wall 66 in covering relation to openings 72 and extending in a rearward direction. LEDs 58 fit within lens casings 74 so as to be protected from damage and also to enhance the degree of illumination of LEDs 58. When light module 12 is formed in heel 14 of footwear 10, lens casings 74 are visible from the exterior thereof in a conventional manner. Preferably, lens case 64, including lens casings 74, is made from an acrylic material.

In order to complete the circuit so as to cause illumination of LEDs 58, a coil extension spring 76 functions as an ON/OFF switch. Specifically, one end of coil extension spring 76 is fixed to a central, upper portion of printed circuit board 60 by a solder joint 79, and is thereby connected via printed circuit board 60 to the negative terminals of LEDs 58. Coil extension spring 76 extends forwardly from printed circuit board 60 to a position above the upper surface of battery 46 which constitutes the negative side of battery 46.

Figure 7:
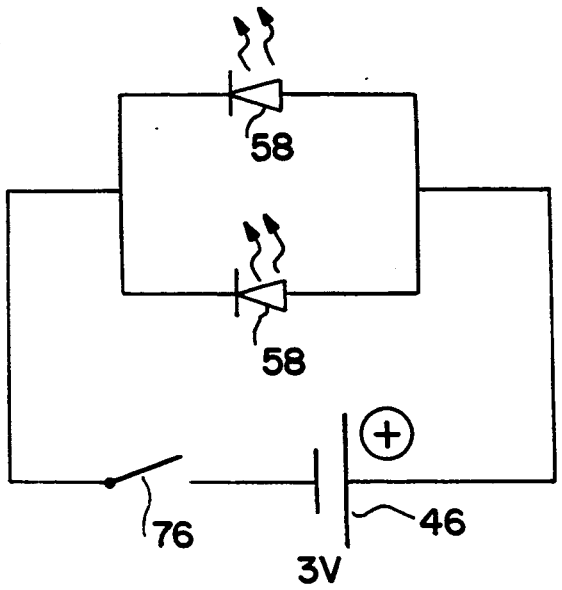
FIG. 7 is a circuit wiring diagram showing the equivalent electric circuitry for the light module.
Figure 2:
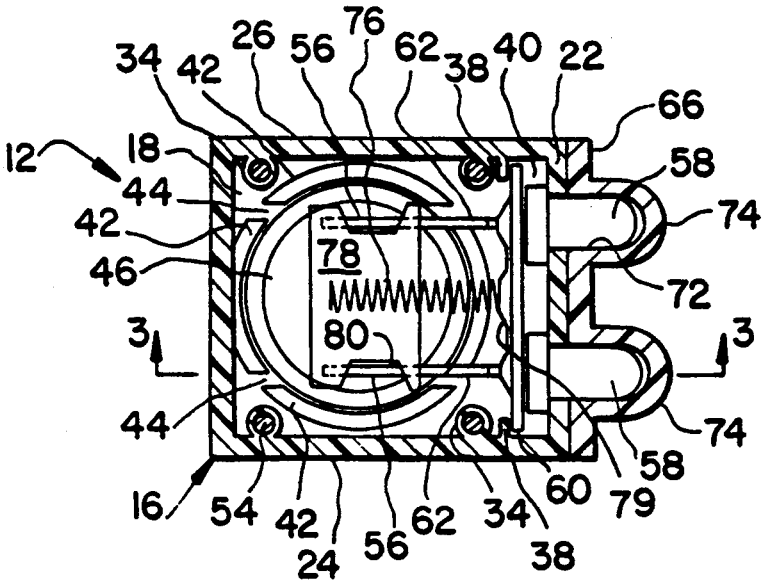
FIG. 2 is a horizontal cross-sectional view of the assembled light module of FIG. 1, also showing the coil spring switch and weight therefor.

Thus, since each positive LED terminal is connected to battery 46 through a positive LED lead 62, and the negative LED terminal is connected to coil extension spring 76, when coil extension spring 76 contacts the upper surface of battery 46, the circuit has been closed, and power is supplied to LEDs 58 to illuminate the same. The equivalent circuit is shown in FIG. 7.

Figure 3:
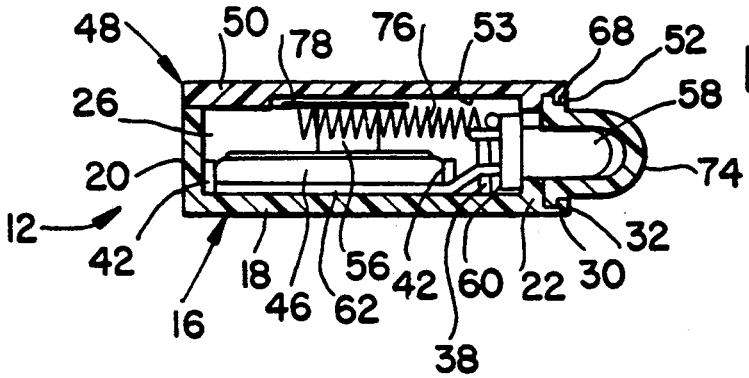
FIG. 3 is a cross-sectional view of the light module of FIG. 2, taken along line 3—3 thereof, when the coil spring switch is in a static state and with the pins of the cover and the posts of the case removed for clarity.
Figure 4:
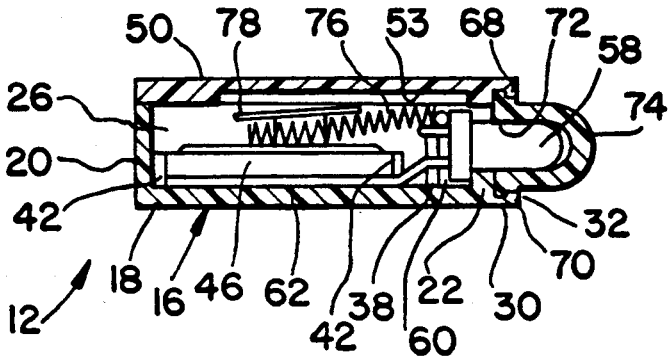
FIG. 4 is a cross-sectional view similar to FIG. 3, showing the state when the light module is activated by vibration and the extension spring is moved downwardly, and with the pins of the cover and the posts of the case removed for clarity.
Figure 5:
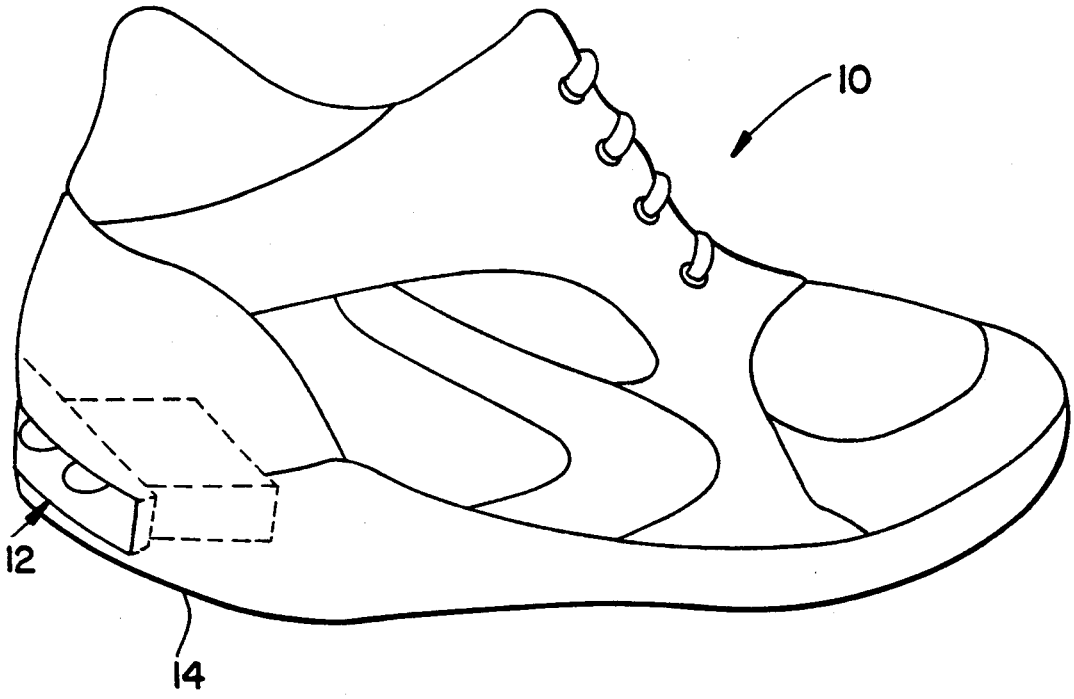
FIG. 5 is a perspective view of a running shoe, with the location of the light module shown in phantom therein.
Figure 6:
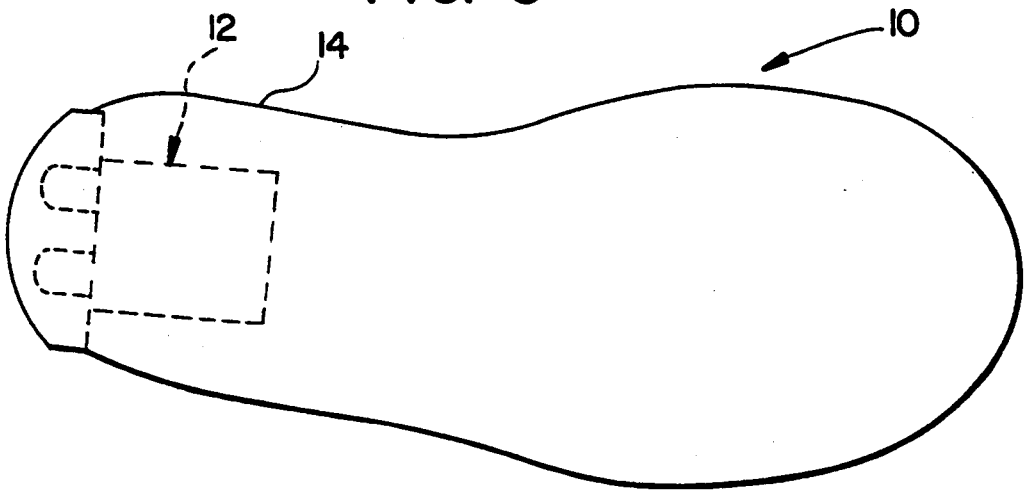
FIG. 6 is a bottom plan view of the running shoe of FIG. 5, with the light module shown in phantom therein.

When light module 12 is in equilibrium, that is, in a static state when footwear 10 is stationary, coil extension spring 76 is designed not to contact battery 46. In other words, coil extension spring 76 has a sufficient stiffness so that it extends horizontally above the upper surface of battery 46, as shown in FIG. 3. Thus, no power is supplied to LEDs 58, and LEDs 58 will not be illuminated.

However, when light module 12 is activated by a simple up and down motion, such as occurs in a stepping motion, this motion will vibrate coil extension spring 76, and the vibrating coil extension spring 76 will contact the upper surface of battery 46 with each vibration. Each time that coil extension spring 76 contacts battery 46, the circuit will be closed and power will be supplied to LEDs 58 to cause the same to emit light visible to human eyes.

It will be appreciated that each vibration will connect the power source, that is, battery 46, to LEDs 58, and also, will function to disconnect the power source from LEDs 58. Thus, when light module 12 is activated by motion, the circuit will alternate between an ON state and an OFF state. Specifically, in the ON state, coil extension spring 76 contacts battery 46 when coil extension spring 76 is moving in a downward motion, which will close the circuit of light module 12. Thus, both the positive LED terminal and the negative LED terminal will be connected to battery 46 so as to cause LEDs 58 to light up, emitting light to human eyes.

However, when coil extension spring 76 is in its upward motion, coil extension spring 76 is not in contact with battery 46. This upward motion of coil extension spring 76 will open the circuit of light module 12, thus disconnecting battery 46 from LEDs 58, so that LEDs 58 will not be illuminated.

Thus, each time the circuit completes these two ON and OFF states, LEDs 58 will emit light so as to simulate a flashing light. When the circuit is opened and closed by the sequential vibrations of motion, for example, while the person is walking, LEDs 58 will emit a series of flashes, which will have a flashing effect visible to human eyes.

Preferably, a plastic weight 78 is added to the top of coil extension spring 76 at the free end thereof, to add weight to coil extension spring 76 and thereby enhance the downward motion which will provide a better connection between coil extension spring 76 and the upper surface of battery 46. This better connecting relation between coil extension spring 76 and battery 46 provides LEDs 58 with a more stable power source which, in turn, provides a higher degree of illumination for LEDs 58. Thus, plastic weight 78 provides a more reliable connecting relation between coil extension spring 76 and battery 46, without affecting the upward motion of each vibration. Of course, the characteristics of coil extension spring 76, such as the thickness of the spring and the like, will have to take into account the effects of plastic weight 78.

Plastic weight 78 has cut-out portions 80 at opposite sides thereof so as to permit ribs 56 therethrough when cover 48 is assembled on case 16.

It will be appreciated that various modifications can be made to the present invention within the scope of the claims. For example, although a coil spring has been used as extension spring 76, a leaf spring or other member that functions as a spring member, can likewise be used.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A light module for use in a heel of footwear, comprising:

light source means for providing Illumination, said light source means having first and second terminals of opposite polarity;

power supply means for supplying power to said light source means;

lead means for constantly connecting said first terminal of said light source means to said power supply means; and switch means, separate from said lead means, for alternately providing electrical connection between said power supply means and said second terminal of said light source means upon movement of said module, said switch means including a coil extension spring having a first end electrically connected with one of said second terminal of said light source means and said power supply means, and an opposite second free end extending out of electrical connection with the other of said second terminal of said light source means and said power supply means when said module is not moving and intermittently being electrically connected with the other of said second terminal of said light source means and said power supply means as a result of movement of said module, such that said power supply means is electrically disconnected from said second terminal of said light source means upon upward motion of said coil extension spring and said power supply means is electrically connected to said second terminal of said light source means upon downward motion of said coil extension spring wherein said light source means is illuminated upon electrical connection of said coil extension spring with said other of said second terminal of said light source means and said power supply means.

2. A light module according to claim 1, wherein said light source means includes at least one light emitting diode.

3. A light module according to claim 1, wherein said light source means includes two light emitting diodes.

4. A light module according to claim 1, further including printed circuit board means for supporting said light source means, and said first end of said coil extension spring is supported by said printed circuit board means, said first end of said coil extension spring being electrically connected via said printed circuit board means to said second terminal of said light source means.

5. A light module according to claim 1, further including weight means supported by said second free end of said coil extension spring to enhance the electrical connection of said second free end with said other of said second terminal of said light source means and said power supply means during said intermittent electrical connection.

6. A light module according to claim 1, further including casing means for holding said light source means, power supply means, lead means and coil extension spring.

7. A light module according to claim 1, further including transparent lens casing means for protecting said light source means and for enhancing the degree of illumination of said light source means.

8. A light module according to claim 1, wherein said power supply means includes a battery.

9. Footwear, comprising:

a heel having a transparent portion; and a light module positioned within said heel, said light module including:

light source means for providing illumination, said light source means being located so as to be visible exteriorly of said heel through said transparent portion thereof and said light source means having first and second terminals of opposite polarity;

power supply means for supplying power to said light source means;

lead means for constantly connecting said first terminal of said light source means to said power supply means; and switch means, separate from said lead means, for alternately providing electrical connection between said power supply means and said second terminal of said light source means upon movement of said footwear, said switch means including a coil extension spring having a first end electrically connected with one of said second terminal of said light source means and said power supply means, and an opposite second free end extending out of electrical connection with the other of said second terminal of said light source means and said power supply means when said footwear is not moving and intermittently being electrically connected with the other of said second terminal of said light source means and said power supply means as a result of movement of said footwear, such that said power supply means is electrically disconnected from said second terminal of said light source means upon upward motion of said coil extension spring and said power supply means is electrically connected to said second terminal of said light source means upon downward motion of said coil extension spring wherein said light source means is illuminated upon electrical connection of said coil extension spring with said other of said second terminal of said light source means and said power supply means.

10. Footwear according to claim 9, wherein said light source means includes at least one light emitting diode.

11. Footwear according to claim 9, wherein said light source means includes two light emitting diodes.

12. Footwear according to claim 9, wherein said light module further includes printed circuit board means for supporting said light source means, and said first end of said coil extension spring is supported by said printed circuit board means, said first end of said coil extension spring being electrically connected via said printed circuit board means to said second terminal of said light source means.

13. Footwear according to claim 9, wherein said light module further includes weight means supported by said second free end of said coil extension spring to enhance the electrical connection of said second free end with said other of said second terminal of said light source means and said power supply means during said intermittent electrical connection.

14. Footwear according to claim 9, wherein said light module further includes casing means for holding said light source means, power supply means, lead means and coil extension spring, said casing means being positioned within said heel.

15. Footwear according to claim 9, wherein said light module further includes transparent lens casing means for protecting said light source means and for enhancing the degree of illumination of said light source means.

16. Footwear according to claim 9, wherein said power supply means includes a battery.

17. Motion activated illuminating footwear, comprising:

a heel having a transparent portion; and a light module positioned within said heel, said light module including:

light source means for providing illumination, said light source means being located so as to be visible exteriorly of said heel through said transparent portion thereof and said light source means having first and second terminals of opposite polarity, printed circuit board means for supporting said light source means, battery means for supplying power to said light source means, lead means for constantly connecting said first terminal of said light source means to said battery means, a coil extension spring, separate from said lead means, for alternately providing electrical connection between said battery means and said second terminal of said light source means upon movement of said footwear, said coil extension spring being electrically connected with said second terminal of said light source means, for intermittently contacting said battery means as a result of movement of said footwear, said coil extension spring having:

a first end supported by said printed circuit board means, said first end of said coil extension spring being electrically connected via said printed circuit board means to said second terminal of said light source means, and an opposite second free end extending out of electrical connection with said battery means when said footwear is not moving and intermittently being electrically connected with said battery means as a result of movement of said footwear, such that said battery means is electrically disconnected from said second terminal of said light source means upon upward motion of said coil extension spring and said battery means is electrically connected to said second terminal of said light source means upon downward motion of said coil extension spring so as to cause illumination of said light source means.

18. Footwear according to claim 17, wherein said light module further includes weight means supported by said second free end of said coil extension spring to enhance the electrical connection of said second free end with said battery means during said intermittent electrical connection.

19. Footwear according to claim 17, wherein said light module further includes casing means for holding said light source means, battery means, lead means and coil extension spring, said casing means being positioned within said heel.

20. Footwear according to claim 17, wherein said light module further includes transparent lens casing means for protecting said light source means and for enhancing the degree of illumination of said light source means.

* * * * *